US005595033A

United States Patent [19]

Frey

[11] Patent Number: 5,595,033

[45] Date of Patent: Jan. 21, 1997

[54] PLASTIC BLOCK

[75] Inventor: John R. Frey, 6863 Karen Ln., Riverside, Calif. 92509

[73] Assignee: John R. Frey, Monterey Park, Calif.

[21] Appl. No.: 450,866

[22] Filed: May 26, 1995

[51] Int. Cl.[6] ..... E04C 1/42

[52] U.S. Cl. ..... 52/306; 52/591.1; 52/592.1; 52/204.62

[58] Field of Search ..... 52/306–308, 588.1, 52/589.1, 591.1, 591.2, 592.1, 567–571, 204.62

[56] References Cited

U.S. PATENT DOCUMENTS

| | | | |
|---|---|---|---|
| 2,228,363 | 1/1941 | Pinney | 52/308 X |
| 3,834,100 | 9/1974 | Healey | 52/607 X |
| 4,117,640 | 10/1978 | Vanderstar | 52/730.3 X |
| 4,648,226 | 3/1987 | Manon | 52/308 |
| 4,677,797 | 7/1987 | Roth | 52/570 X |
| 4,891,925 | 1/1990 | Carlson et al. | 52/306 X |
| 4,899,508 | 2/1990 | Biebuxck | 52/730.3 X |
| 5,031,372 | 7/1991 | McCluer | 52/307 |
| 5,033,245 | 7/1991 | Kline | 52/306 |
| 5,038,542 | 8/1991 | Kline | 52/307 X |
| 5,367,846 | 11/1994 | vonRoenn | 52/308 |

FOREIGN PATENT DOCUMENTS

| | | | |
|---|---|---|---|
| 0437716 | 11/1967 | Switzerland | 52/592.1 |

*Primary Examiner*—Robert Canfield

[57] ABSTRACT

A plastic block comprising of a generally rectangular plastic block consisting of contoured faces on opposite sides connected by adjoining edges. These blocks give the appearance of glass blocks without the weight, fragility, or cost of standard glass blocks commonly used as decorative wall components. These blocks consist of interlocking male and female connectors integral to the side wall of the blocks so as to facilitate assembly.

4 Claims, 6 Drawing Sheets

PLASTIC BLOCK

BACKGROUND OF THE INVENTION

1. Field of Invention

This invention relates generally to the interlocking of translucent plastic blocks commonly used as decorative wall construction. More specifically this invention will assemble in a manner that permits a fenestration system or wall to be constructed in a multitude of configurations.

2. Description of Prior Art

Plastic blocks have been the construction industry for some time as a substitute for glass blocks. Prior art of previous plastic blocks is shown in U.S. Pat. No. 3,798,861 to Weiss and U.S. Pat. No. 4,891,925 to Carlson and Cadson.

U.S. Pat. No. 3,798,861 to Weiss discloses an interlocking translucent plastic modular blocks suitable as a replacement for glass blocks. These blocks have a retaining strip between the blocks that does not produce a desirable appearance of a conventional glass block wall.

U.S. Pat. No 4,891,925 to Carlson and Carlson also substitute plastic blocks as a substitute for glass blocks but they use separate clips to interlock each block. This has the disadvantage of difficult assembly since each block must be lined up before assembly of the unit.

OBJECTS AND SUMMARY OF THE INVENTION

The primary object of this invention is to provide a method of assembly that can improve the method of assembly as well as provide a multitude of configurations.

A further object of this invention is to eliminate extraneous parts required to assemble the units.

A further object of this invention is to provide a double square block that facilitates injection molding and makes the units more economical and that can still be halved where needed with a simple saw cut without losing the integrity of the unit.

DESCRIPTION OF THE EMBODIMENT SHOWN IN FIG 1.

Items 1, 2, and 3 comprise the metal frame assembly of the plastic block. Item 1 is the metal frame which contains the plastic block. Item 2 is the plastic block assembly which is comprised of two identical molded pieces joined together with either adhesive or sonically or vibratory welded. Item 3 is sealant applied to the plastic block and/or metal frame after assembly of the unit

DESCRIPTION OF THE EMBODIMENT SHOWN IN FIGS. 2 AND 3

Figure 1:
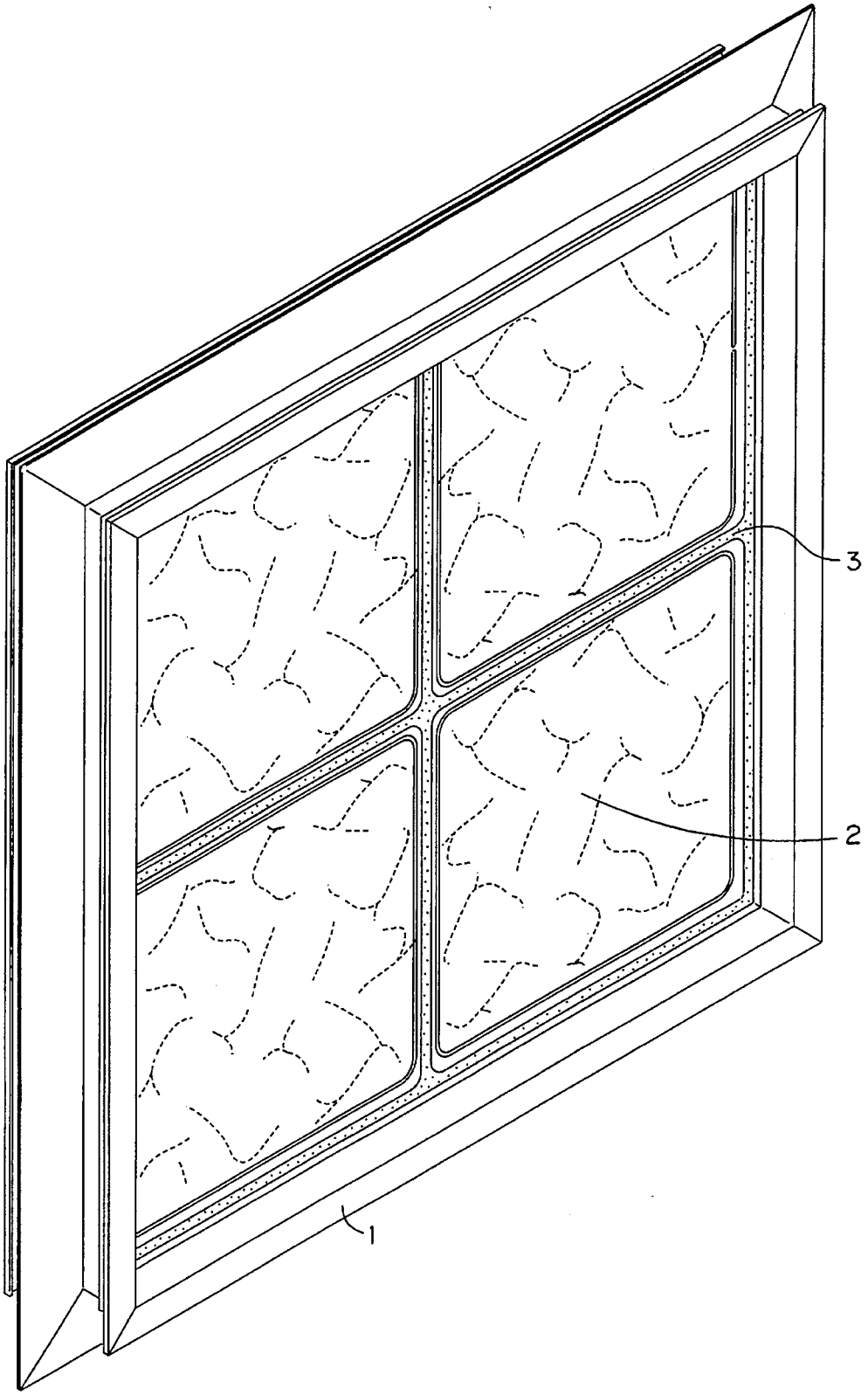
FIG. 1 is an isometric view of the assembled plastic block invention.
Figure 2:
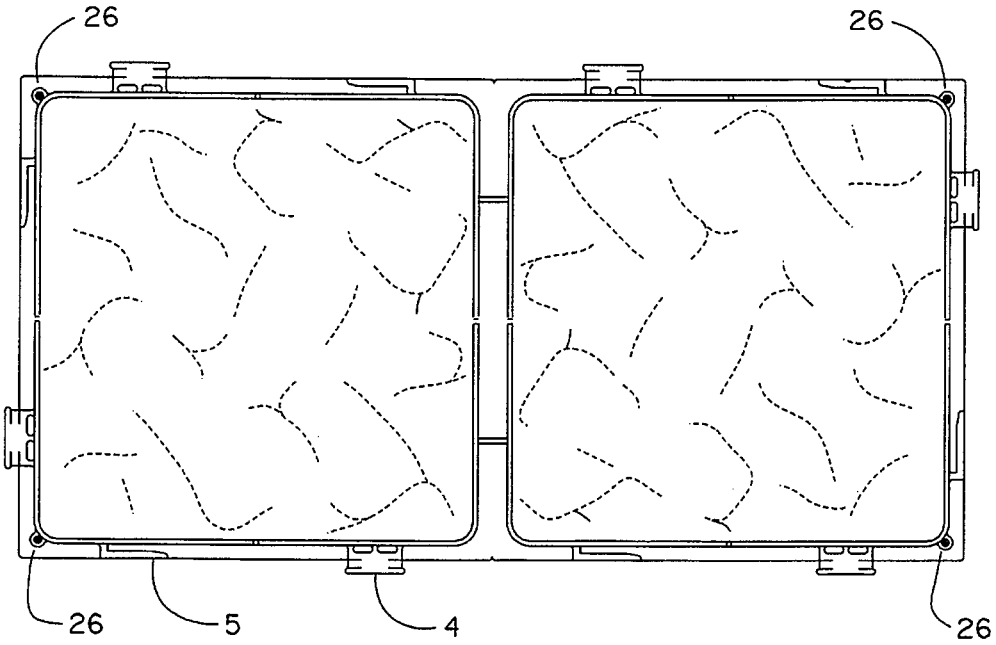
FIG. 2 is a side view an assembled plastic block.
Figure 3:
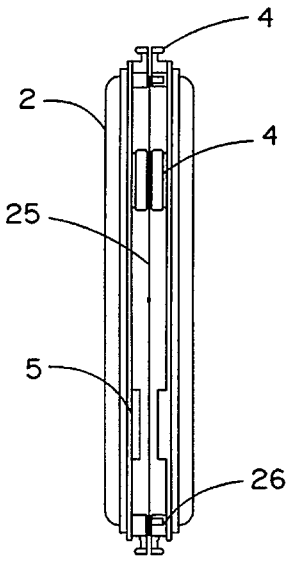
FIG. 3 is a plan view of an assembled plastic block.

Referring to FIG. 2 the embodiment discloses an unassembled glass block invention. Item 4 discloses the integral male connector. Item 5 discloses the integral female connector. Item 26 discloses the alignment pins used for alignment of the block halves as they are assembled into one unit. Referring to FIG. 3 item 2 discloses the assembled plastic block with two identical molded halves. Item 25 discloses the joint between the two identical halves. The two identical halves are bonded either using an adhesive or sonic or vibratory welded item 26 discloses the guide pins used to mate the two identical halves. There are two pins per molded half.

DESCRIPTION OF THE EMBODIMENT SHOWN IN FIG. 4

Figure 4:
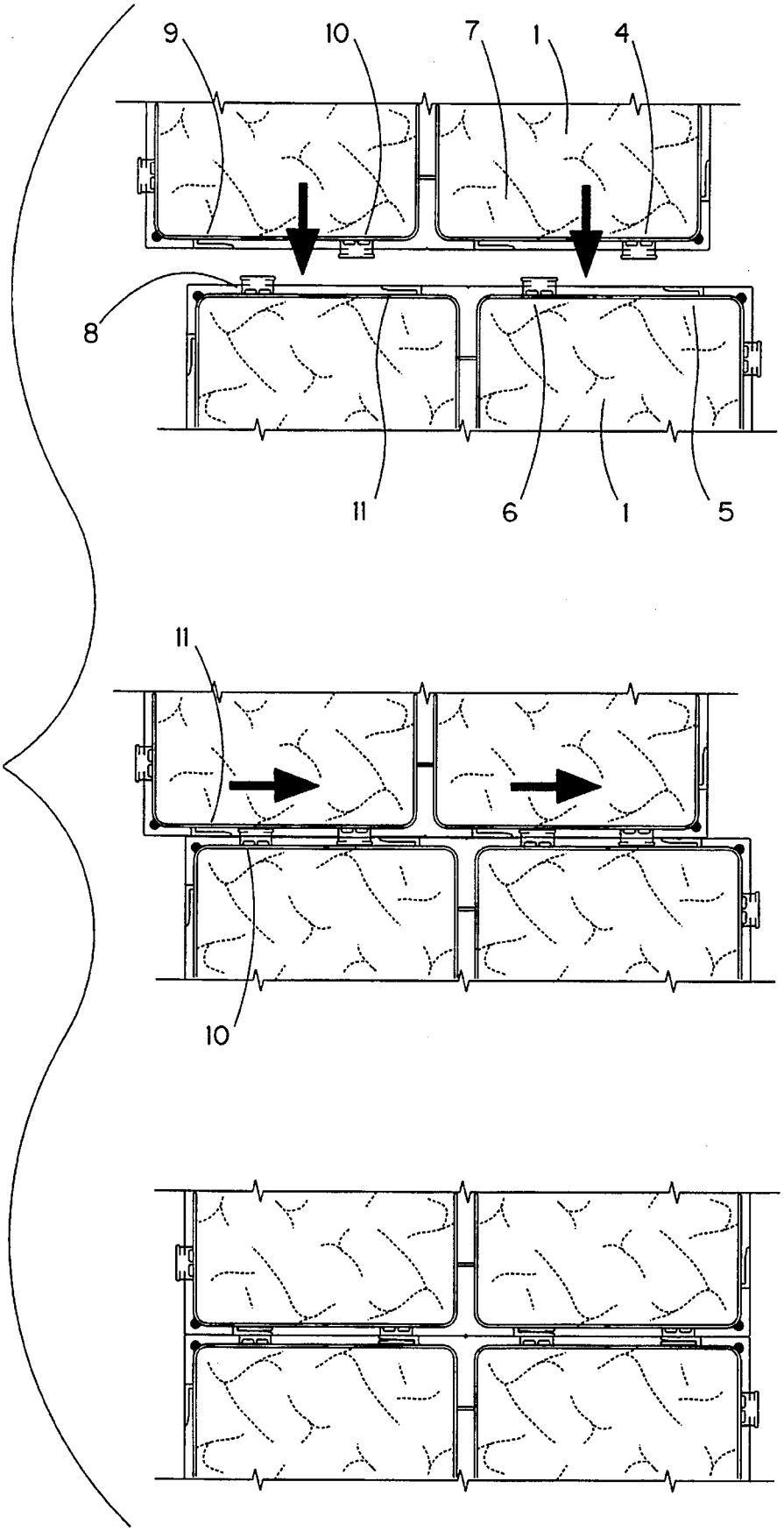
FIG. 4 is a fragmentary view of the movement of two blocks as they are assembled

Referring to FIG. 4 the embodiment discloses the manner in which item 1 is mated as like them. Item 4, the integral male connector, is shown as it engages item 5, the integral female connector, and stops as the two blocks are aligned in their fully engaged position. At the same instant items 4,5,6,7,8,9,10, and 11 become fully engaged in their respective mates thus creating a fully secure assembly between two or more block assemblies.

DESCRIPTION OF THE EMBODIMENT SHOWN IN FIGS. 5, 6, 7 AND 8

Figure 5:
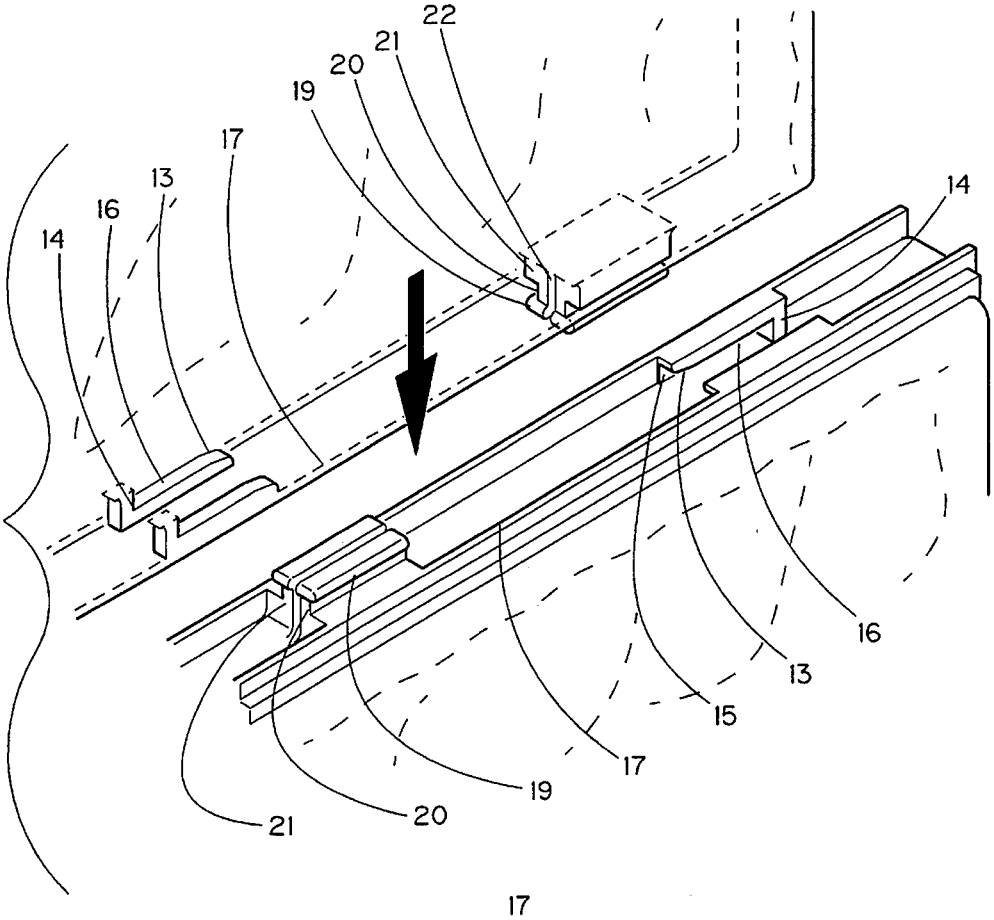
FIG. 5 is a fragmentary isometric view of the block before it is engaged in the adjoining block.
Figure 6:
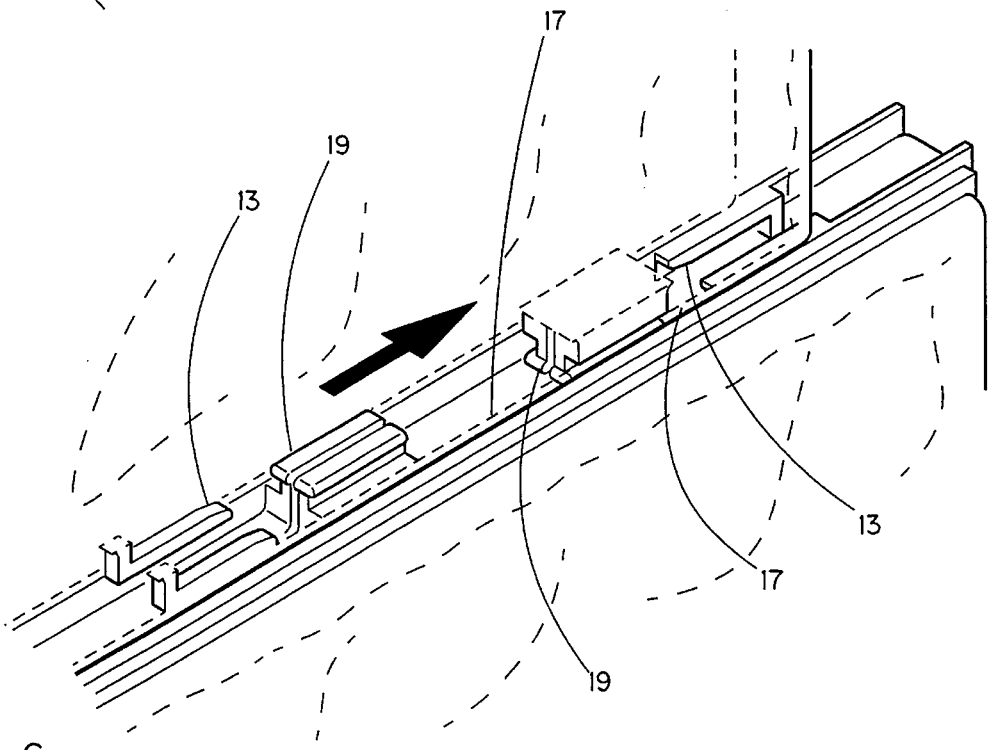
FIGS. 6 and 7 are fragmentary isometric views showing the movement of the block as it engages an adjoining block.
Figure 7:
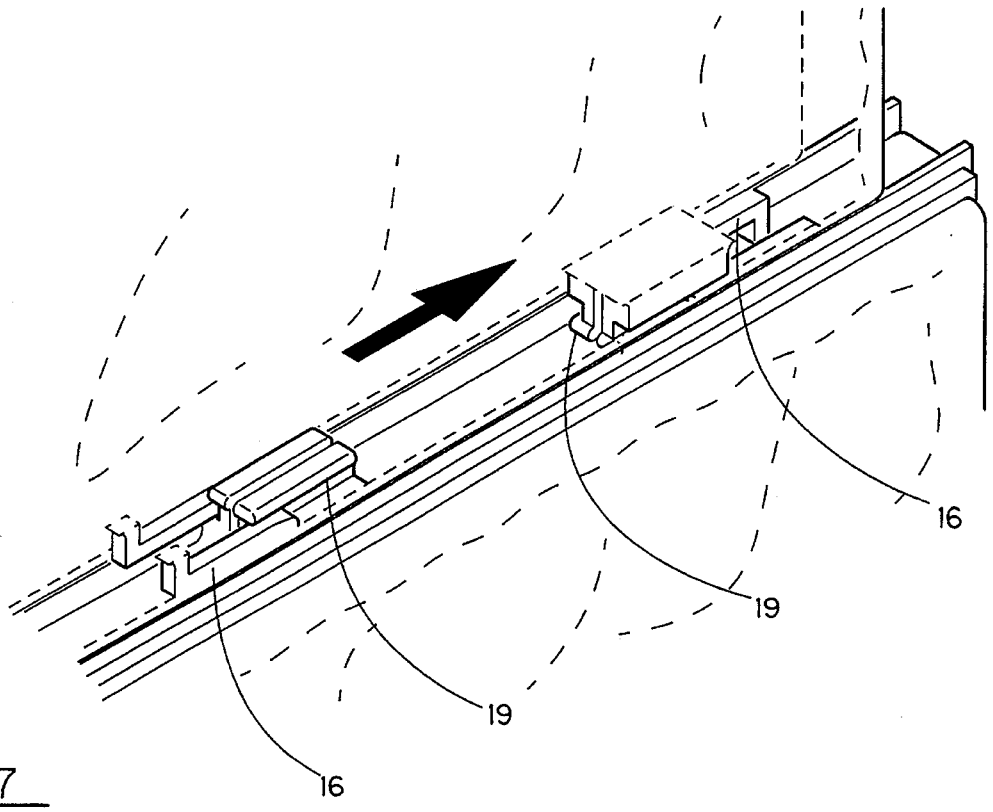
Figure 8:
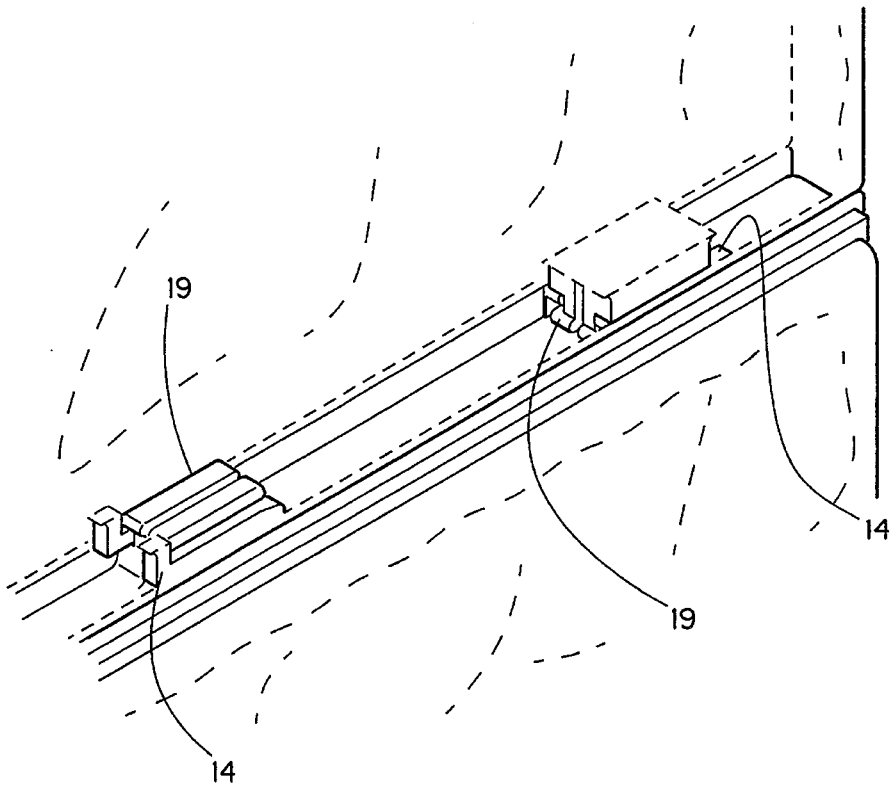
FIG. 8 is a fragmentary isometric view showing the block fully engaged with an adjacent block.

FIGS. 5, 6, 7, and 8 the embodiments discloses the plastic block assemblies as they are adjoined to each other. Referring to FIG. 5 the embodiment discloses the detail of the block connectors as they are assembled. Items 13,14,15, and 16 comprise the female portion of the integral connecting system. The female connector is comprised of two alike halves. Items 12,19,20,21, and 22 comprise the male portion of the integral connecting system. The male connector is also comprised of two alike halves. Each block has opposing 2 sets of male and female integral connectors for each eight inch section of block. Referring to FIG. 5 item 17 is a portion of the blocks which when assembled will provide a backing for sealing the final assembly. Item 17 discloses an appendage extending from the main body of the block which runs continuous along the entire edge of the block and includes portions of the male and female connectors. Item 21 discloses a wall extending each half of the male connector from item 17 and the main body of the block. Item 19 discloses an appendage 90 degrees to item 21. Item 20 discloses a void which is formed by items 17, 19, and 21. Item 22 discloses a void formed by 21 from each half of the male connector. Item 15 discloses an extension at the female connector of item 17 so that the male connector is confined in side to side movement. Item 16 discloses an appendage extending 90 degrees from item 15 Item 13 discloses a ramp on item 16 which allows item 19 to ride into the female connector. Item 14 discloses a wall extending between item 15, 16 and 17 which forms a stop as the male connector is slid into the female connector. Referring to FIG. 6 item 17 slides along item 17 on the adjacent block until item 19 engages item 13. Referring to FIG. 7 item 19 continues along until it engages item 16 Referring to FIG. 8 item 19 continues along item 16 until it stops against item 14 thus aligning the two blocks as shown.

DESCRIPTION OF THE EMBODIMENT SHOWN IN FIGS. 9 AND 10

Figure 9:
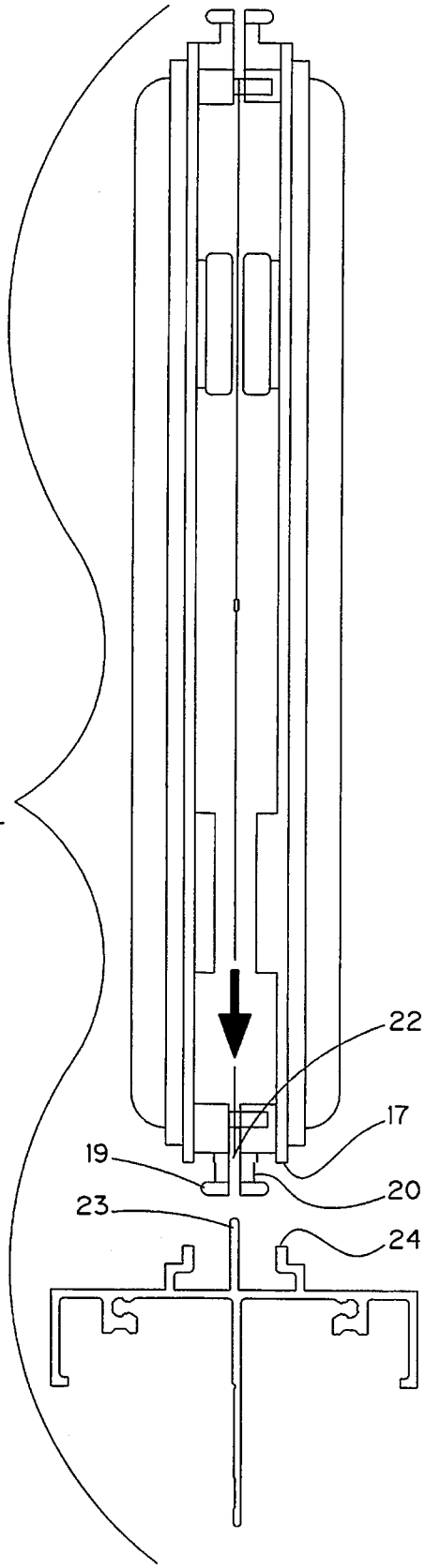
FIG. 9 is a longitudinal sectional view showing the movement of the block as it is contained into the metal frame.
Figure 10:
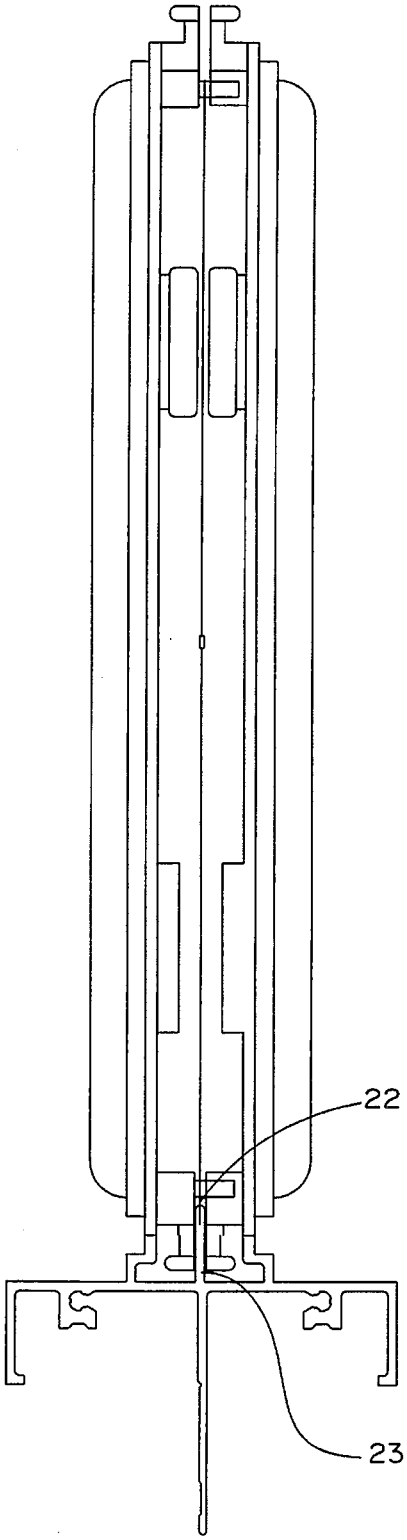
FIG. 10 is a longitudinal sectional view showing the relationship of the block and metal frame.

Referring to FIG. 9 the embodiment discloses the assembly of the metal frame and the plastic block invention. Items 19, 20, 22, 23, and 24 comprise the mating elements between the frame and plastic block. Item 22 discloses a void in the plastic block assembly in the integral male connector by items 17, 19 and 20. Item 23 discloses an appendage in the aluminum frame which will engage the block at item 22. This assembly centers the block in the frame. Item 24 discloses an appendage on the aluminum frame. Item 17 engages item 24 to rest against the frame. Referring to FIG. 10 the embodiment discloses the assembly of items 22 and 23 in the fully engaged position.

I claim:

1. A generally rectangular hollow block:

said rectangular block comprised of two like halves joined together to comprise one complete rectangular hollow block, said halves each comprising two square faces and a flange parallel to the two square faces extending throughout the full perimeter of the halves forming edges of which;

each square face having three sides comprised of the edges; each side having one male locking member at one end and one female locking member at an opposite end;

said halves joined such that the male locking members of each half align to form male locking devices and the female locking members of each half align to form female locking devices;

each female locking device recessed below the edges forming a channel to receive a male locking device;

each male locking device extending beyond the edges and comprised of two legs normal to the edges defining a void therebetween;

the legs of the male locking devices being adapted to engage a lead in on a female locking device to secure said block to an adjacent like block.

2. A generally rectangular block as in claim 1 wherein the block is made from a material selected from the group of acrylic, polycarbonate, and plastic.

3. The combination of the hollow block of claim 1 with a metal frame wherein:

said metal frame is comprised of three parallel fins and one fin normal to said three fins, two of said three parallel fins being outer fins which abut edges of said block, one of said three parallel fins being a center fin engaging the void of a male locking device to contain the block.

4. The combination as in claim 3 wherein the metal frame is made of extruded aluminum.

* * * * *